US008322761B2

(12) United States Patent
Itami et al.

(10) Patent No.: US 8,322,761 B2
(45) Date of Patent: Dec. 4, 2012

(54) APPARATUS FOR CONTROLLING OPENING/CLOSING BODY

(75) Inventors: Eiji Itami, Chiryu (JP); Takeshi Nishikibe, Anjo (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/120,274

(22) PCT Filed: Oct. 28, 2009

(86) PCT No.: PCT/JP2009/068503

§ 371 (c)(1),
(2), (4) Date: Mar. 22, 2011

(87) PCT Pub. No.: WO2010/058686

PCT Pub. Date: May 27, 2010

(65) Prior Publication Data

US 2011/0181051 A1 Jul. 28, 2011

(30) Foreign Application Priority Data

Nov. 18, 2008 (JP) ..... 2008-294608

(51) Int. Cl.
*E05C 3/06* (2006.01)
*E05C 3/16* (2006.01)

(52) U.S. Cl. ..... 292/201; 292/216; 292/DIG. 46

(58) Field of Classification Search ..... 292/201, 292/216

See application file for complete search history.

(56) References Cited

U.S. PATENT DOCUMENTS 4,762,348 A * 8/1988 Matsumoto ..... 292/201
5,520,425 A * 5/1996 Dowling ..... 292/201
5,938,251 A * 8/1999 Watanabe ..... 292/201
6,065,315 A * 5/2000 Hoshikawa et al. ..... 70/264
6,223,468 B1 * 5/2001 Kobayashi ..... 49/280
6,386,599 B1 * 5/2002 Chevalier ..... 292/201

(Continued)

FOREIGN PATENT DOCUMENTS

JP 2003-120105 A 4/2003

OTHER PUBLICATIONS

International Search Report (PCT/ISA/210) issued on Dec. 8, 2009, by Japanese Patent Office as the International Searching Authority for International Application No. PCT/JP2009/068503.
Written Opinion (PCT/ISA/237) issued on Dec. 8, 2009, by Japanese Patent Office as the International Searching Authority for International Application No. PCT/JP2009/068503.

(Continued)

*Primary Examiner* — Carlos Lugo
(74) *Attorney, Agent, or Firm* — Buchanan Ingersoll & Rooney PC

(57) ABSTRACT

An apparatus for controlling an opening/closing body for automatically opening/closing the opening/closing body. The apparatus includes a displacement body movable and displaced between movable regions including a closing region, a releasing region and a neutral region, a neutral detecting first switch configured to output a first detection signal in response to passage of the displacement body through a first boundary portion of the neutral region, a neutral detecting second switch configured to output a second detection signal in response to passage of the displacement body through a second boundary portion of the neutral region, and a control unit for effecting braking control for reducing the moving speed of the opening/closing body if neither the first detection signal nor the second detection signal are detected within a predetermined period after starting of a neutral returning movement which is effected after a latch closing movement of the opening/closing body.

6 Claims, 9 Drawing Sheets

U.S. PATENT DOCUMENTS

| | | | | |
|---|---|---|---|---|
| 6,499,776 | B2 * | 12/2002 | Takamura | 292/201 |
| 6,542,071 | B1 * | 4/2003 | Ohtsubo et al. | 340/426.28 |
| 6,669,247 | B2 * | 12/2003 | Swan | 292/201 |
| 6,698,804 | B2 * | 3/2004 | Shiota et al. | 292/201 |
| 6,719,356 | B2 * | 4/2004 | Cleland et al. | 296/146.8 |
| 6,848,727 | B1 * | 2/2005 | Cetnar et al. | 292/201 |
| 6,964,438 | B2 * | 11/2005 | Koike et al. | 292/201 |
| 6,974,165 | B2 * | 12/2005 | Koike et al. | 292/216 |
| 2001/0005079 | A1 * | 6/2001 | Takamura | 292/201 |
| 2002/0030366 | A1 * | 3/2002 | Swan | 292/201 |
| 2003/0067175 | A1 | 4/2003 | Shiota et al. | |
| 2009/0165386 | A1 | 7/2009 | Suzuki et al. | |
| 2010/0270815 | A1 * | 10/2010 | Shinoda et al. | 292/201 |

OTHER PUBLICATIONS

Owner's Manual of New *Estima* Hybrid chapter 11: Body & Electrical, rear seat door 11-66 through 11-69, Toyota Motor Corporation, issued Jun. 12, 2006.

Notification of Transmittal of Translation of the International Preliminary Report on Patentability (Form PCT/IB/338) dated Jul. 11, 2011, International Preliminary Report of Patentability (Form PCT/IB/373) and Written Opinion of the International Searching Authority (Form PCT/ISA/237) dated Jun. 21, 2011, issued in corresponding International Patent Application No. PCT/JP2009/068503.

* cited by examiner (a)

(b)

APPARATUS FOR CONTROLLING OPENING/CLOSING BODY

TECHNICAL FIELD

The present invention relates to an apparatus for controlling an opening/closing body, the apparatus being capable of a latch closing operation for establishing engagement between a latch and a striker, and a latch releasing operation for releasing the engagement between the latch and the striker, with rotational displacement based on a motor operation.

BACKGROUND ART

Conventionally, there is known an automobile door lock operating apparatus for effecting a locking operation with rotation of an actuator output shaft in the forward direction and an unlocking operation with rotation of the actuator output shaft in the reverse direction. There is also known a vehicle door closer apparatus configured such that a latch closing operation is effected in response to displacement in one direction of a driven gear as a displacement body receiving power of a reversibly rotatable motor thereby to pivot a latch for drawing in a striker and a latch releasing operation is effected in response to displacement in the other direction of the driven gear thereby to pivot a pawl for releasing engagement between the latch and the pawl.

This type of apparatuses include a releasing function for releasing engagement between a latch and a striker by displacing a displacement body such as a sector gear receiving motor power in a releasing direction relative to a neutral region and a closing function for causing the latch to draw in the striker by displacing the displacement body in a closing direction relative to the neutral region. In the course of these, if the displacement body is to be displaced to the neutral region by the motor power after execution of the releasing function or the closing function, a neutral detecting means such as a switch is needed for controlling stopping of the motor.

However, if a trouble occurs in this neutral detecting means, there is the risk of the displacement body being moved inadvertently to its displacement terminal end. Namely, in such case, after the execution of a latch closing operation, the displacement body could enter inadvertently into a latch releasing operation rather than being stopped at the neutral region as it should be, as a result of which the door after being once closed may be opened unintentionally. Also, after the execution of a latch releasing operation, the displacement body could enter inadvertently into a latch closing operation rather than being stopped at the neutral region as it should be, as a result of which the door after being once unlocked may be locked unintentionally.

As a technique for overcoming such problem as above, in the case of the technique disclosed in a Non-Patent Document 1 identified blow, the technique controls such that the latch releasing operation is effected forcibly if the returning movement of the displacement body to the neutral region ("neutral returning movement") has taken time longer than a predetermined period ("time over"). In addition, according to the Non-Patent Document 1, the technique also controls such that the latch closing operation is effected upon establishment of starting conditions for the latch closing operation in the neutral returning movement (the condition of shifting of a half latch switch from OFF to ON and the further condition of a rear seat door courtesy switch turning ON).

PRIOR ART DOCUMENT

Non-Patent Document

Non-patent Document 1: Owner's Manual of New Estima Hybrid (chapter 11: Body & Electrical, rear seat door 11-66~11-69, TOYOTA MOTOR CORPORATION, issued Jun. 12, 2006).

SUMMARY OF THE INVENTION

Problem to be Solved by Invention

However, in the case of a latch closing operation effected based of establishment of starting conditions for a latch closing operation in the course of a neutral returning movement as disclosed in Non-patent Document 1, when e.g. the neutral returning movement is a neutral returning movement from the latch releasing operation, there is the possibility that the latch closing operation is effected in spite of absence of proper engagement between the latch and the striker, whereby the latch pivots freely, i.e. without proper engagement, thus causing inappropriate engagement or meshing. This occurs because the meshing engagement between the latch and the striker has been released by the latch releasing operation effected previously. As a result, the rear seat door cannot be retained under the fully closed condition and the rear seat door becomes free, not being retained to the vehicle body. So, the rear seat door may be opened/closed inadvertently against the user's intension.

The present invention has been made in view of the above-described problem. Its object is to provide an opening/closing body controlling apparatus capable of preventing opening/closing of an opening/closing body against the user's intension, after release of the latch.

Means for Accomplishing the Object

For accomplishing the above-noted object, an apparatus for controlling an opening/closing body for automatically opening/closing the opening/closing body, relating to the present invention, the apparatus comprises:

a latch for drawing in and releasing a striker;

a displacement body for operating said latch via a latch operating mechanism, said displacement body being movable and displaced between movable regions including a latch closing region for drawing in said latch, a latch releasing region for releasing said latch and a neutral region located between said latch closing region and said latch releasing region;

a first detecting section configured to output a first detection signal in response to passage of the displacement body through a first boundary portion of the neutral region on the side of the closing region;

a second detecting section configured to output a second detection signal in response to passage of the displacement body through a second boundary portion of the neutral region on the side of the releasing region; and a control unit for effecting braking control for reducing the moving speed of the opening/closing body if neither the first detection signal nor the second detection signal are detected within a predetermined period after starting of a neutral returning movement which is effected after the latch closing movement of the opening/closing body for returning said displacement body from said latch closing region to said neutral region.

With the above-described characterizing construction, even if the opening/closing body has started moving without detection of the first detection signal from the first detecting section and without detection of the second detection signal from the second detecting section, after the start of the neutral returning movement in the course of the latch closing movement, the control unit effects the control for reducing the moving speed of the opening/closing body after lapse of a predetermined period. Hence, it is possible to prevent inadvertent opening/closing of the opening/closing body against the user's intension.

According to a further characterizing feature of the present invention, an apparatus for controlling an opening/closing body for automatically opening/closing the opening/closing body, comprises:

a latch for drawing in and releasing a striker;

a displacement body for operating said latch via a latch operating mechanism, said displacement body being movable and displaced between movable regions including a latch closing region for drawing in said latch, a latch releasing region for releasing said latch and a neutral region located between said latch closing region and said latch releasing region;

a first detecting section configured to output a first detection signal in response to passage of the displacement body through a first boundary portion of the neutral region on the side of the closing region;

a second detecting section configured to output a second detection signal in response to passage of the displacement body through a second boundary portion of the neutral region on the side of the releasing region; and a control unit for effecting braking control for starting a latch closing movement and reducing the moving speed of the opening/closing body if a drawing-in condition for said striker by said latch is established when neither the first detection signal nor the second detection signal are detected within a predetermined period after starting of a neutral returning movement which is effected after the latch closing movement of the opening/closing body for returning said displacement body from said releasing region to said neutral region.

With the above-described characterizing construction, in a neutral returning movement of the displacement body which is effected after a latch releasing movement of this displacement body, if a drawing-in condition for the striker is established without detection of the first detection signal and the second detection signal within the predetermined period, a latch closing movement is started and also a braking control is effected. Therefore, even if a latch closing movement is effected under a condition where the striker and the latch are not engageable with each other, the moving speed of the opening/closing body is restricted by the braking control. As a result, inadvertent opening/closing of the opening/closing body against the user's intension can be avoided. Further, collision between the striker and the latch under the non-engageable condition can be avoided also, thus preventing damage or deformation in the striker and the latch.

Preferably, said control unit is configured to monitor the moving speed of the opening/closing body in case the latch closing movement is effected in the absence of detections of the first detection signal and the second detection signal and to determine presence/absence of said braking control based on the monitored moving speed.

With the above-described construction, it becomes possible to judge whether the moving speed of the opening/closing body is the moving speed thereof based on a normal latch closing movement of the opening/closing body or not. Therefore, the inadvertent opening/closing of the opening/closing body against the user's intension can be avoided even more reliably.

Further, preferably, said apparatus further comprises a clutch mechanism disposed between said opening/closing body and a motor for opening/closing this opening/closing body, said clutch mechanism transmitting/interrupting the power of said motor; and said braking control is configured to render the moving speed of said opening/closing body below a predetermined speed.

With the above-described construction, even if the opening/closing body is opened/closed against the user's intension, the moving speed of the opening/closing body can be easily controlled to rendered below a predetermined speed.

Further, preferably, said control unit is configured to effect said braking control based upon a map showing correlation between moving speeds of the opening/closing body and power transmitting/interrupting periods of said clutch mechanism.

With the above-described construction, the power transmitting/interrupting period of the clutch mechanism can be easily set in accordance with the moving speed of the opening/closing body. Therefore, the braking control of the opening/closing body can be effected appropriately.

Still preferably, said control unit is configured to render the moving speed of the opening/closing body zero in said braking control.

With this construction, it becomes possible to prevent sudden unlocking of the opening/closing body.

MODE FOR EMBODYING THE INVENTION

Figure 1:
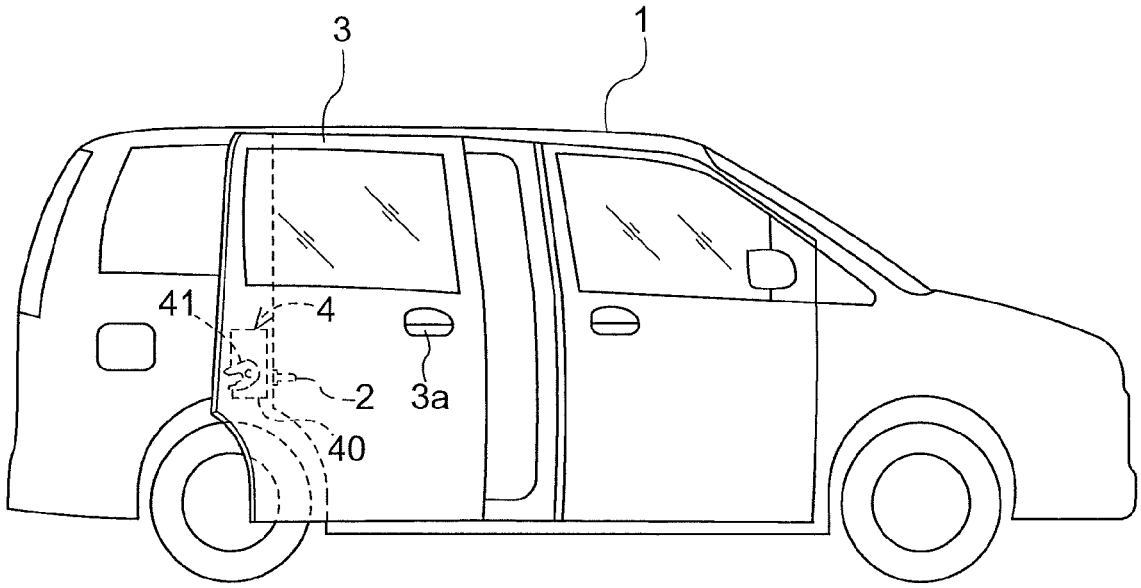
FIG. 1 is a view showing a lateral side of a vehicle mounting an opening/closing body controlling apparatus.

Next, an opening/closing body controlling apparatus 100 relating to the present invention will be described. This opening/closing body controlling apparatus 100 has a function of automatically opening/closing an opening/closing body. In this embodiment, there will be described a case of using the opening/closing body controlling apparatus 100 for opening/closing a slide door 3 of a vehicle. Therefore, in the instant embodiment, the slide door 3 provided in a vehicle corresponds to the "opening/closing body" as defined herein. FIG. 1 is a view showing a lateral side of a vehicle mounting the opening/closing body controlling apparatus 100. Further, FIG. 2 is a view schematically showing in enlargement of a striker 2 and a door locking device 4 included in the opening/closing body controlling apparatus 100.

Figure 2:
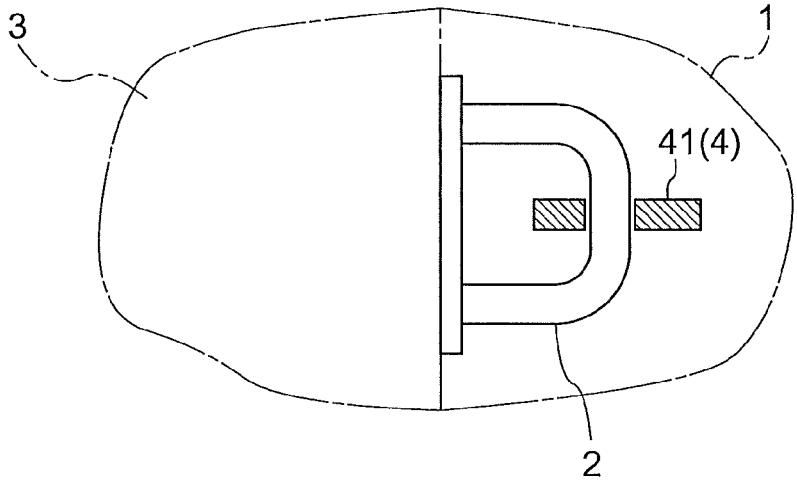
FIG. 2 is a view schematically showing in enlargement of a striker and a door locking device.

FIGS. 1 and 2 show the door locking device 4 disposed between a vehicle body 1 mounting the opening/closing body controlling apparatus 100 and the slide door 3. In the instant embodiment, the door locking device 4 includes a door opening/closing operation mechanism 40 provided on the side of the slide door 3 and the striker 2 provided on the side of the vehicle body 1. This striker 2, as shown in FIG. 1, is disposed on a vehicle rear side of an opening of the vehicle door 1 which is exposed when the slide door 3 is opened. Needless to say, the striker 2 may be disposed on the vehicle front side of the opening. Further, on the outer lateral face of the slide door 3, an opening handle 3*a* is mounted.

Figure 3:
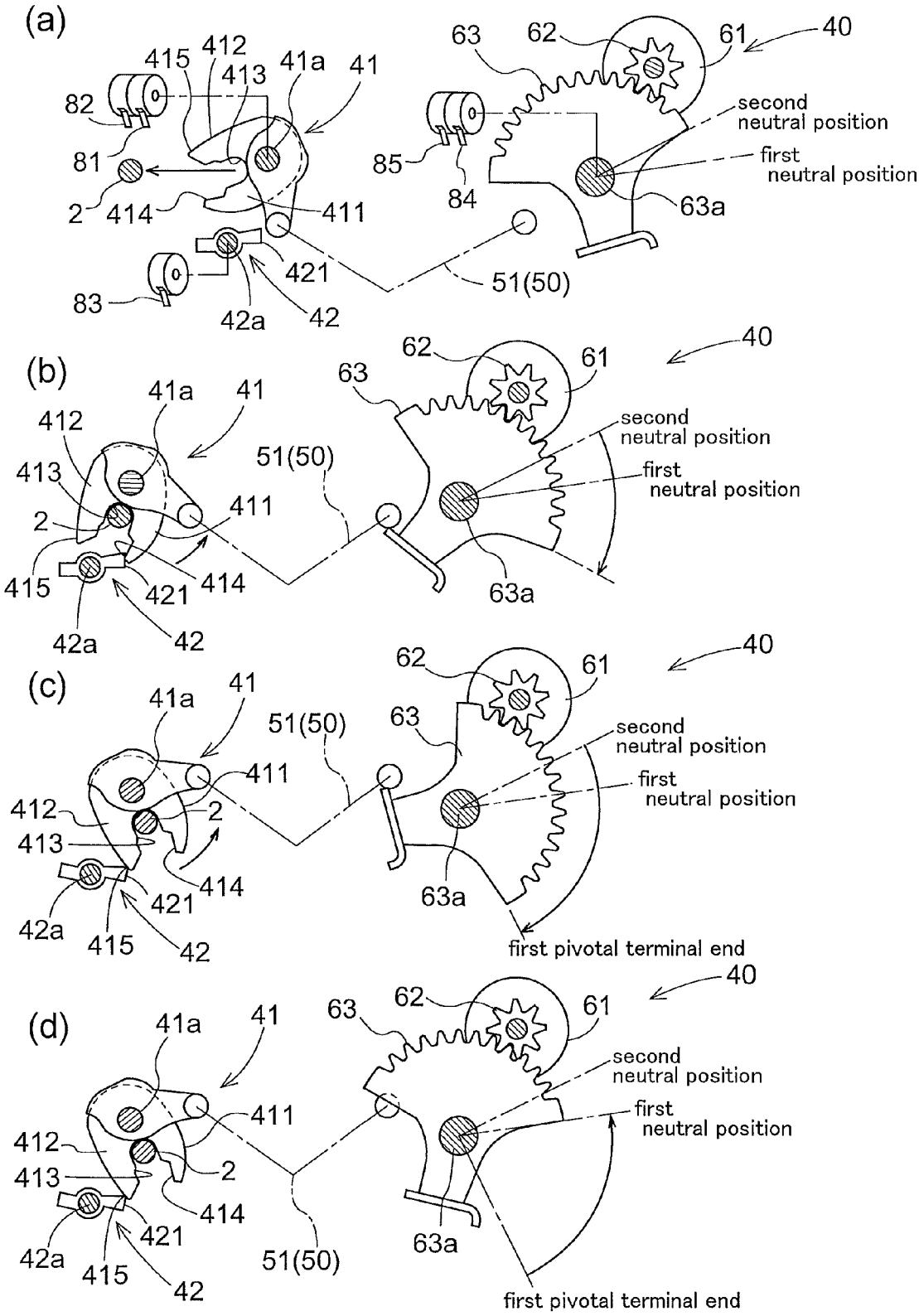
FIG. 3 is a view showing a locked condition of a door opening/closing operation mechanism.
Figure 4:
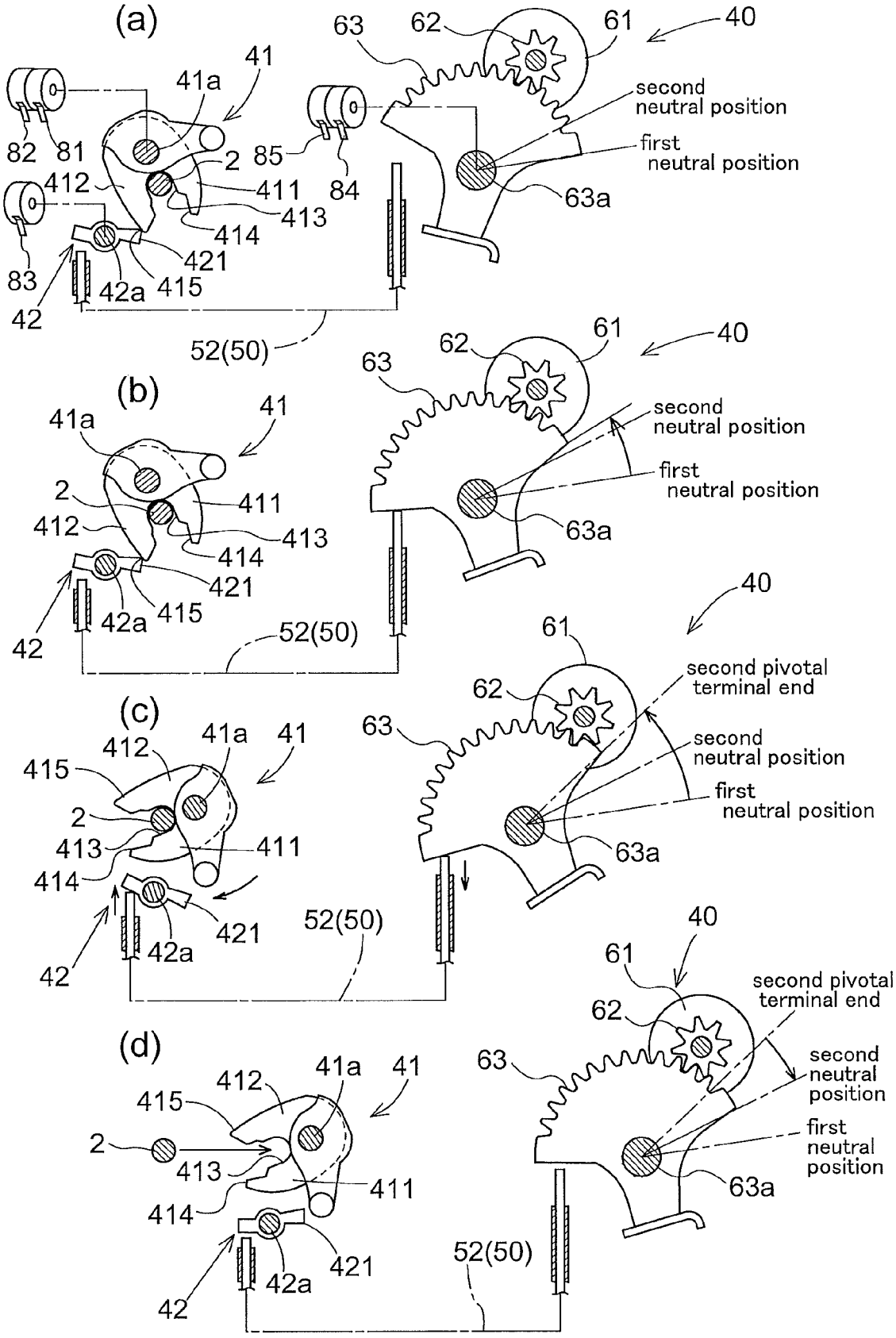
FIG. 4 is a view showing a released condition of the door opening/closing operation mechanism.

The door opening/closing mechanism 40 effects a locking operation and a lock releasing operation of the slide door 3. FIG. 3 is a view showing a locking movement of the door opening/closing operation mechanism 40. FIG. 4 is a view showing a lock releasing movement of the door opening/closing operation mechanism 40. The door locking device 4 includes a latch 41 for effecting drawing-in and releasing of the striker 2, a pawl 42 for restricting pivoting of the latch 41 by the ratchet technique, and a latch operating mechanism 50 for operating the latch 41 and the pawl 42. The latch 41 is comprised of a plate-like member capable of drawing in the striker 2 toward the body of the slide door 3.

In order to provide operating displacements to the latch operating mechanism 50, there are provided a motor 61, a pinion gear 62 acting as a speed changing gear for changing the speed of rotation of the motor 61, and a sector gear (corresponding to the "displacement body" as defined in this invention) 63 for operating the latch 41 via the latch operating mechanism 50. The sector gear 63 is supported to be pivotable about a pivot shaft 63*a* disposed in an unillustrated housing.

Further, as will be detailed later, the sector gear 63 is moved/displaced between movable regions including a closing region for drawing in the latch 41, a releasing region for releasing the latch 41, and a neutral region disposed between the closing region and the releasing region. This movement is realized by rotational power outputted from the motor 61.

The latch 41 is supported to be pivotable about a pivot shaft 41*a* disposed in the unillustrated housing and urged to a returning posture as shown in FIG. 3 (*a*) by means of e.g. a spring (not shown). The latch 41 includes a first arm portion 411 and a second arm portion 412; and between these portions, there is formed an engaging recess 413 capable of receiving the striker 2 therein. The first arm portion 411 includes a half-engaging face 414 engageable with a contact acting portion 421 of the pawl 42 at a half latch position. Further, the second arm portion 412 includes a full engaging face 415 engageable with the contact acting portion 421 of the pawl 42 at a full latch position.

The pawl 42 is supported to be pivotable about a pivot shaft 42*a* between an engaging posture and a releasing posture. Further, the pawl 42 is disposed such that under the above engaging posture and releasing posture, the contact acting portion 421 thereof is located within the pivotal path of the first arm portion 411 or the second arm portion 412 of the latch 41. Further, the pawl 42 is urged to return to the engaging posture by means of e.g. a spring (not shown).

Figure 5:
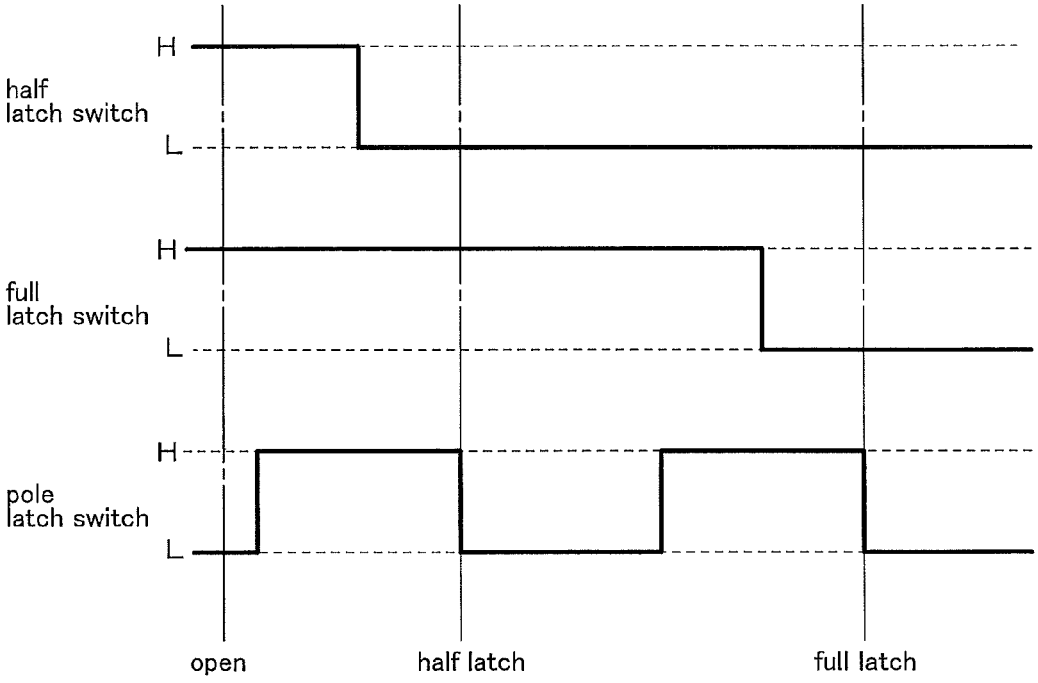
FIG. 5 is a view showing switching of outputs from respective switches.

As position detectors for detecting pivotal positions of the latch 41, a half latch switch 81 and a full latch switch 82 in the form of rotary switches are provided on a detection-target cylinder pivotable about the pivot shaft 41*a* together with the latch 41. The half latch switch 81 detects presence of the latch 41 in the half latch region. The full latch switch 82 detects presence of the latch 41 in the full latch region. Incidentally, in the instant embodiment, as illustrated in FIG. 5, the half latch switch 81 is configured to be switched over from "High" (ON) to "Low" (OFF) when the latch 41 has moved from the opening position to a position before the half latch position. Similarly, the full latch switch 82 is configured to be switched over from "High" (ON) to "Low" (OFF) when the latch 41 has moved from the half latch position to a position before the full latch position.

Referring back to FIG. 3, as a position detector for detecting the pivotal position of the pawl 42, a pawl switch 83 in the form of a rotary switch is provided on a detection-target cylinder pivotable about the pivot shaft 42*a* together with the pawl 42. The pawl switch 83 detects the pawl 42 being under a posture engaged with the latch 41. In this embodiment, the pawl switch 83, as illustrated in FIG. 5, is turned "High" (ON) when the pawl 42 is located in the region before and including the half clutch position engaged with the first arm portion 411 of the latch 41. Further, the pawl switch 83 is turned "High" (ON) when the pawl 42 is located in the region before and including the full clutch position engaged with the second arm portion 412 of the latch 41. That is, in the closing movement of the slide door 3, the first falling point of the pawl switch 83 corresponds to the half latch position and the second falling point thereof corresponds to the full latch position, respectively.

The latch operating mechanism 50 includes a latch closing operation mechanism 51 (see FIG. 3) and a latch releasing operation mechanism 52 (see FIG. 4). The latch closing operation mechanism 51 inputs a pivotal displacement of the sector gear 63 and outputs a pivotal operational force for the latch 41. The latch releasing operation mechanism 52 inputs a pivotal displacement of the sector gear 63 and outputs a pivotal operational force (engagement releasing operation) for the pawl 42. The closing region as the pivotal region of the sector gear 63 in which the latch closing operation mechanism 51 is effective and the releasing region as the pivotal region of the sector gear 63 in which the latch releasing operation mechanism 52 is effective are distinct from each other across a neutral region (the details thereof will be described later). Therefore, the latch closing operation mechanism 51 and the latch releasing operation mechanism 52 function distinctly from each other.

A detection-target cylinder pivotable together with the sector gear 63 about its pivotal shaft 63*a* mounts a neutral detecting first switch 84 as a "first detecting section" and a neutral detecting second switch 85 as a "second detecting section" in the form of rotary switches for detecting pivotal displacement postures of the sector gear 63.

Figure 6:
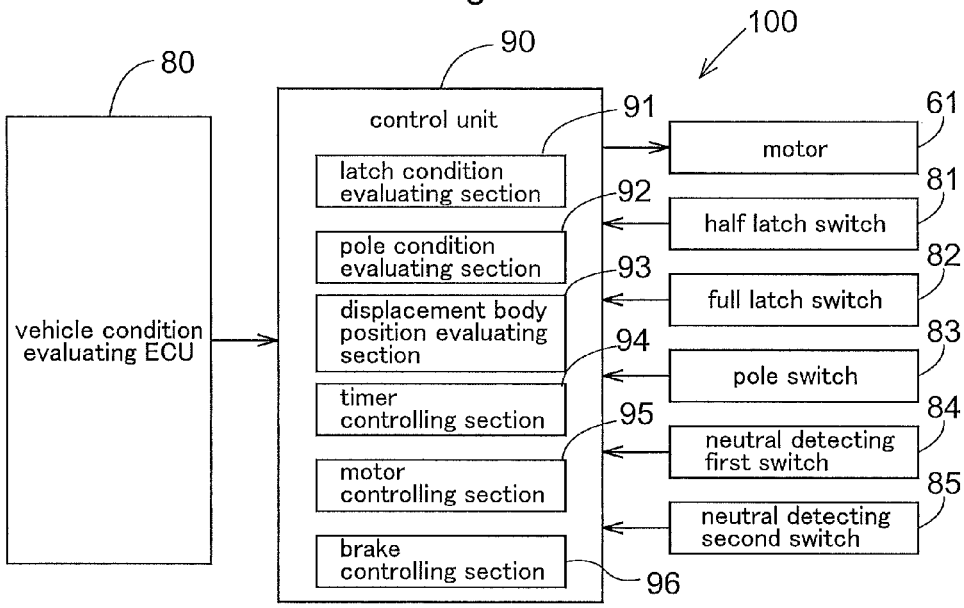
FIG. 6 is a block diagram schematically showing a general construction of a control unit.

FIG. 6 is a block diagram schematically showing a general construction of a control unit 90 for controlling the door opening/closing operation mechanism 40. To input portions of the control unit 90, there are connected the half clutch switch 81, the full latch switch 82, the pawl switch 83, a neutral detecting first switch 84 and a neutral detecting second switch 85. And, to an output port of the control unit 90, the motor 61 is connected via an unillustrated driver. Further, this control unit 90 is connected also to a vehicle condition evaluating ECU 80 for evaluating condition of the vehicle and outputting vehicle condition information, so that the control unit 90 can obtain vehicle condition information relating to opening/closing of the slide door 3.

The control unit 90 is composed of a latch condition evaluating section 91, a pawl condition evaluating section 92, a displacement body position evaluating section 93, a timer controlling section 94, a motor controlling section 95 and a brake controlling section 96. And, in this control unit 90, the above-described functional sections thereof for effecting various operations for opening/closing the slide door 3 are comprised of hardware and/or software, with a CPU as the core component thereof.

The latch condition evaluating section 91 evaluates the condition of the latch 41 based on the signals from the half latch switch 81 and the full latch switch 82. The pawl condition evaluating section 92 evaluates the condition of the pawl 42 based on the signal from the pawl switch 83. The displacement body position evaluating section 93 evaluates the pivotal position of the sector gear 63 based on the first detection signal from the neutral detecting first switch 84 and the second detection signal from the neutral detecting second switch 85. The timer controlling section 94 effects timer control with using an internal timer or the like. The motor controlling section 95 generates and output control signals for the motor 61, based on the results of evaluations by the latch condition evaluating section 91, the pawl condition evaluating section 92 and the displacement body position evaluating section 93, and on the timer information from the timer controlling section 94. Though will be described in details later, the brake controlling section 96 controls the moving speed of the slide door 3 to render it to a speed below a predetermined speed, when some abnormal condition has developed in the course of the controlling process of the door opening/closing operation mechanism 40.

Figure 7:
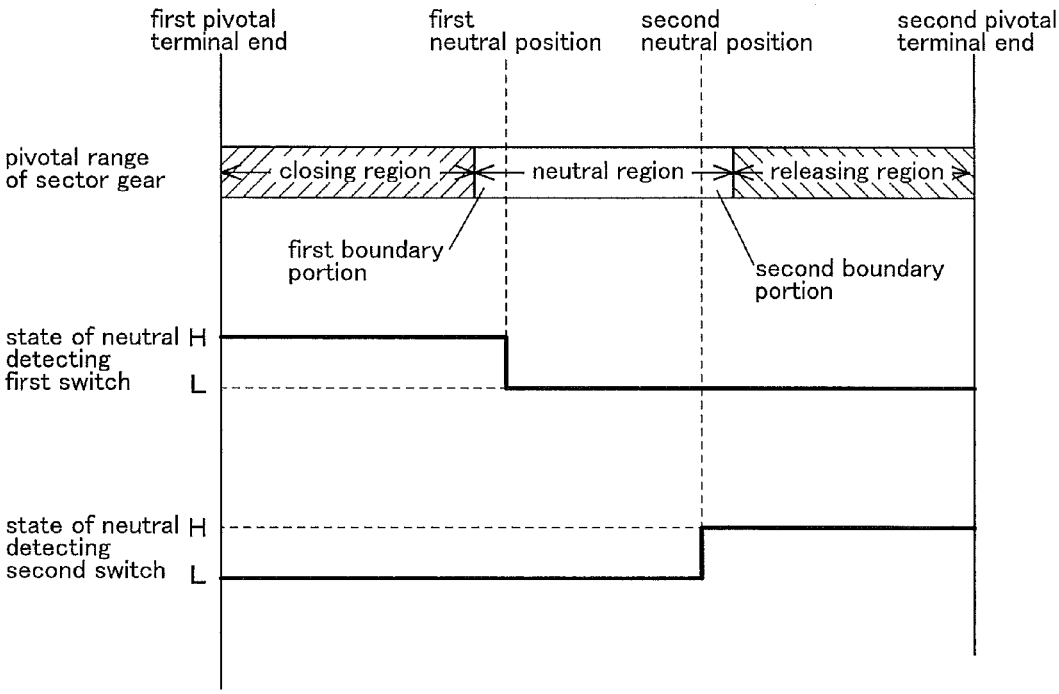
FIG. 7 is a view showing pivotal regions of a sector gear relating to a latch closing movement.
Figure 8:
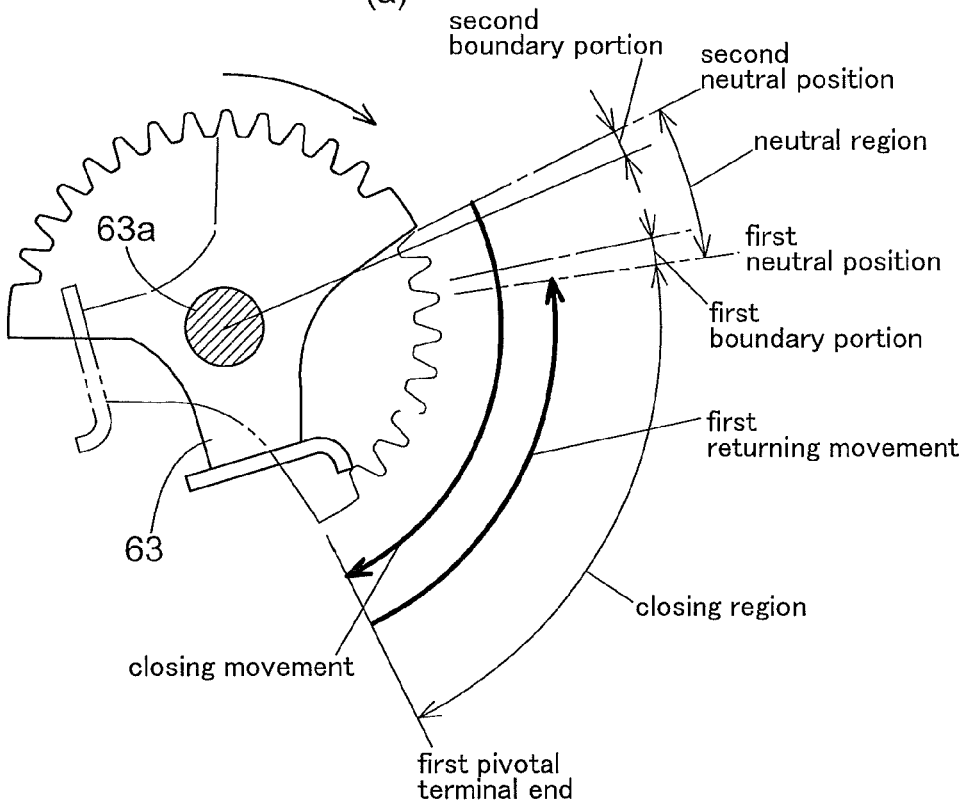
FIG. 8 is a view showing pivotal regions of the sector gear relating to a latch releasing movement.
Figure 8:
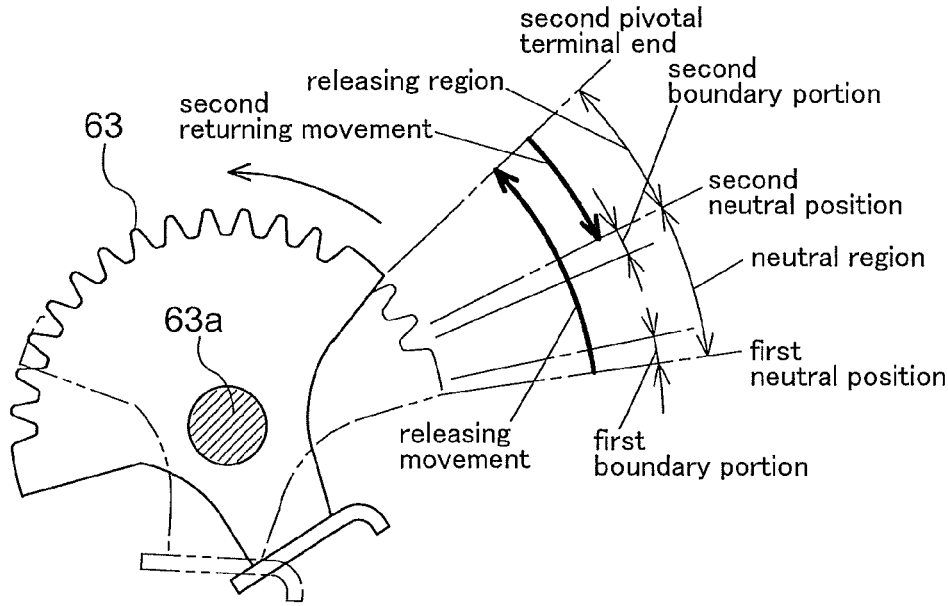

The latch closing movement for drawing the striker 2 into the latch 41 is effected by operating the latch closing operation mechanism 51 through the sector gear 63. And, the latch releasing movement for releasing the striker 2 from the latch 41 is effected by operating the latch releasing operation mechanism 52 through the sector gear 63. The pivotal regions of the sector gear 63 for providing the latch closing movement and the latch releasing movement are sectioned from each other such that the closing region and the releasing region are provided across the neutral region therebetween as illustrated in FIG. 7 and FIG. 8. Further, at the closing side boundary portion of the neutral region, there is set a first boundary portion having a predetermined pivotal width, whereas at the releasing side boundary portion of the neutral region, there is set a second boundary portion having a predetermined pivotal width. And, the neutral region side borderline of the first boundary portion is set as a "first neutral position" and the neutral region side borderline of the second boundary portion is set as a "second neutral position", respectively.

As the sector gear 63 is pivoted in the closing region toward the first pivotal terminal end which is the closing region side pivotal terminal end (clockwise pivotal movement in FIG. 8), a latch closing movement is provided (see FIG. 8 (*a*)). And, after the latch closing movement of the sector gear 63 (upon completion of the latch closing movement), there is effected a first returning movement (neutral returning movement) for returning the sector gear 63 from the closing region to the neutral region. In this first returning movement, the sector gear 63 is pivoted counter-clockwise (counterclockwise pivotal movement in FIG. 8) to pass through the closing region to enter the neutral region and to stop eventually at the first neutral position.

Further, as the sector gear 63 is pivoted in the releasing region toward the second pivotal terminal end (counterclockwise pivotal movement in FIG. 8), a latch releasing movement is provided (see FIG. 8 (*b*)). And, after the latch releasing movement of the sector gear 63 (upon completion of the latch releasing movement), there is effected a second returning movement (neutral returning movement) for returning the sector gear 63 from the releasing region to the neutral region. In this second returning movement, the sector gear 63 is pivoted in reverse (clockwise pivotal movement in FIG. 8) to pass through the releasing region to enter the neutral region and to stop eventually at the second neutral position.

The above-described neutral detecting first switch 84 includes an electrode face formed in the peripheral face of the detection-target cylinder rotatable together with the sector gear 63 and a brush coming into contact with this electrode face over a predetermined pivotal area of the sector gear 63. The electrode face of the neutral detecting first switch 84 is disposed so as to come into contact with the brush when the pivotal position of the sector gear 63 is located in the closing region or the first boundary portion. Accordingly, this neutral detecting first switch 84 outputs the first detection signal when the sector gear 63 has passed through the closing region side first boundary region in the neutral region. More particularly, as shown in FIG. 7, the neutral detecting first switch 84 outputs, as the first detection signal, a High signal when the pivotal position of the sector gear 63 is in the closing region or the first boundary portion and outputs a Low signal otherwise, i.e. when the sector gear 63 is at the other pivotal positions.

The neutral detecting second switch 85 too has a similar construction to the neutral detecting first switch 84. However, its electrode face is disposed so as to come into contact with the brush when the pivotal position of the sector gear 63 is located in the releasing region or the second boundary region. Accordingly, this neutral detecting second switch 85 outputs the second detection signal when the sector gear 63 has passed through the releasing region side second boundary region in the neutral region. More particularly, as shown in FIG. 7, the neutral detecting second switch 85 outputs, as the second detection signal, a High signal when the pivotal position of the sector gear 63 is in the releasing region or the second boundary portion and outputs a Low signal otherwise, i.e. when the sector gear 63 is at the other pivotal positions.

Referring now back to FIG. 3 and FIG. 4, the conditions of the sector gear 63, the latch 41 and the pawl 42 in the latch closing operation and latch releasing operation will be described. FIGS. 3 (*a*) through (*d*) schematically show various phases of a latch closing movement and a neutral returning movement subsequent thereto. FIGS. 4 (*a*) through (*d*) schematically show various phases of a latch releasing movement and a neutral returning movement subsequent thereto.

A latch closing movement is effected when the slide door 3 currently opened relative to the vehicle body 1 is to be closed. When the slide door 3 is under the opened state, the pivotal position of the sector gear 63 becomes the second neutral position shown in FIG. 3 (*a*) by the neutral returning movement accompanying the latch releasing movement. When the slide door 3 under the opened state is moved in the closing direction, the door opening/closing operation mechanism 40 provided on the slide door 3 side approaches the striker 2 fixed to the vehicle body 1. Then, the engaging recess 413 of the latch 41 in the door opening/closing operation mechanism 40 receives the striker 2 therein.

When the slide door 3 is further moved, as shown in FIG. 3 (*b*), the contact acting portion 421 of the pawl 42 comes into engagement with the first arm portion 411 of the latch 41 (half latch position). Slightly before arrival of the latch 41 at the half latch position, the motor 61 is driven in the forward direction and the sector gear 63 is pivoted. In association with this pivotal movement of the sector gear 63, in cooperation with the latch closing operation mechanism 51, the latch 41 starts pivoting by the motor power. Incidentally, in this stage, the slide door 3 is not yet completely closed relative to the vehicle body 1.

When the sector gear 63 is further pivoted to the terminal pivotal position of the closing region, as shown in FIG. 3 (*c*), the contact acting portion 421 of the pawl 42 comes into engagement with the second arm portion 412 of the latch 41 (full latch position). In this stage, the slide door 3 is completely closed relative to the vehicle door 1.

Upon completion of the latch closing movement, for the neutral returning movement of the sector gear 63, the motor 61 is driven in reverse. As shown in FIG. 3 (*d*), the pivotal position of the sector gear 63 reaches the first neutral position, whereby the signal of the neutral detecting first switch 84 becomes High (ON) to Low (OFF). In response to this, the sector gear 63 is stopped at this position. In this way, the door opening/closing operation mechanism 40 effects a closing operation of the slide door 3.

A latch releasing movement is effected when the slide door 3 currently closed relative to the vehicle body 1 is to be opened. When the slide door 3 is under the closed state, the pivotal position of the sector gear 63 becomes the second neutral position shown in FIG. 4 (*a*) by the neutral returning movement accompanying the latch closing movement. When the motor 61 is driven in reverse in response to an operation of e.g. an unillustrated switch provided in the opening handle 3*a* of the slide door 3, the sector gear 63 is pivoted in the direction for the releasing region.

When the sector gear 63 is pivoted, in cooperation with the latch releasing operation mechanism 52, the pawl 42 begins to pivot in the engagement releasing direction. As shown in FIG. 4 (*c*), when the contact acting portion 421 of the pawl 42 is moved away from the latch 41, under the urging force of the spring, the pawl 42 returns to the home position as the releasing posture. And, the latch 41 too is returned to the posture for releasing the striker 2, under the spring urging force. In this stage, it becomes possible to open the slide door 3 relative to the vehicle body 1.

Upon completion of the latch releasing movement, by the neutral returning movement of the sector gear 63, the motor 61 is driven forwardly. As shown in FIG. 4 (*d*), when the pivotal position of the sector gear 63 reaches the second neutral position and the signal of the neutral detecting second switch 85 changes from High (ON) to Low (OFF), the sector gear 63 is stopped at this position. In this way, the door opening/closing operation mechanism 40 effects an opening operation of the door 3.

Here, with the inventive opening/closing body controlling apparatus 100, upon completion of the closing movement of the slide door 3, the first returning movement of the sector gear 63 is effected. In this first returning movement, when the sector gear 63 is pivoted in reverse and passes through the closing region to enter the neutral region, the sector gear 63 is stopped at the first neutral position. Detection of this first neutral position is effected, based on change of the signal of the neutral detecting first switch 84 from High (ON) to Low (OFF).

However, if such change of the signal of the neutral detecting first switch 84 from High (ON) to Low (OFF) cannot be detected due to e.g. some abnormality in the neutral detecting first switch 84, there is the possibility of the sector gear 63 passing through the neutral region to enter the releasing region inadvertently. In such case, the opening/closing body controlling apparatus 100 may erroneously determine that an opening operation of the slide door 3 is about to take place, whereby an erroneous operation may take place. For this reason, in the case of the inventive opening/closing body controlling apparatus 1000, the detection of the sector gear 63 in the first returning movement after a latch closing operation is effected, based not only on the change of the signal of the neutral detecting first switch 84 from High (ON) to Low (OFF), but also on change of the signal of the neutral detecting second switch 85 from Low (OFF) to High (ON).

Therefore, in the first returning movement after a latch closing operation, if the change of the signal of the neutral detecting first switch 84 from High (ON) to Low (OFF) cannot be detected, then the change of the signal of the neutral detecting second switch 85 from Low (OFF) to High (ON) is detected. With this, it becomes possible to stop the sector gear 63 in the neutral region appropriately. Incidentally, if the change of the signal of the neutral detecting second switch 85 from Low (OFF) to High (ON) is detected, the sector gear 63 is stopped at the second neutral position.

Further, with the opening/closing body controlling apparatus 100 according to the present invention, in the first returning movement after a latch closing operation, in case neither the change of the signal of the neutral detecting first switch 84 from High (ON) to Low (OFF), nor the change of the signal of the neutral detecting second switch 85 from Low (OFF) to High (ON) are detected, the sector gear 63 may reach the releasing region. In such case, the opening/closing body controlling apparatus 100 will erroneously determine that a latch releasing operation of the slide door 3 has been started and the latch releasing movement may be allowed to continue, whereby the slide door 3 may be opened suddenly. For this reason, with this opening/closing body controlling apparatus 100 has an arrangement for preventing such sudden opening of the slide door 3 as follows.

The control unit 90 included in the opening/closing body controlling apparatus 100 is configured to monitor the moving speed of the slide door 3 and to determine presence/absence of braking control based upon the monitored moving speed in case neither the first detection signal nor the second detection signal are detected after starting of the first returning movement. More particularly, with this control unit 90, if neither the first detection signal nor the second detection signal are detected within a predetermined period after start of the first returning movement, the unit 90 effects a brake control for reducing the moving speed of the slide door 3. In this, the start of first returning movement corresponds to timing of switchover of the rotational direction of the motor 61. That is, this is the timing that the control unit 90 controls such that the condition of the motor 61 being rotated clockwise in latch closing operation is changed the condition of the motor 61 being rotated in the counterclockwise direction for the shifting to the first returning movement. The time lapse from the start of the first returning movement is measured by the timer controlling section 94 described above. And, when the measured time has reached the predetermined period, the power transmitted from the motor 61 to the sector gear 63 is transmitted or interrupted, thereby to effect the brake control for reducing the moving speed of the slide door 3 to a speed below a predetermined speed. This preset determination period is set as such period as from the start of the first returning movement of the sector gear 63 to the passing of the gear through the second neutral position.

Figure 11:
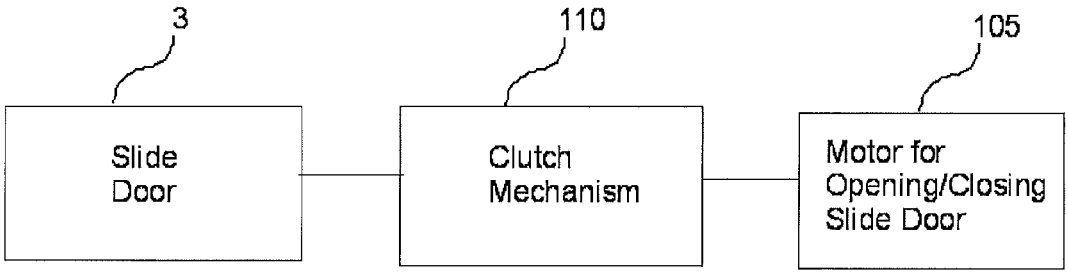
FIG. 11 schematically illustrates the slide door, the clutch mechanism and the motor for opening/closing the slide door.

In the above, in the inventive opening/closing body controlling apparatus 100, between the slide door 3 and a motor 105 for opening/closing this slide door 3, there is provided a clutch mechanism 110 for transmitting/interrupting the power of this motor as schematically illustrated in FIG. 11. More particularly, when this clutch mechanism 110 is rendered into its engaged condition, the power of the motor 105 can be transmitted to the slide door 3. Whereas, when the clutch mechanism 110 is rendered into its non-engaged condition, the power of the motor 105 is not permitted to be transmitted to the slide door 3.

And, as described above, when the lapsed time after start of the first returning movement has passed the preset period, the control unit 90 effects the brake control by controlling the power transmitting/interrupting period of the clutch mechanism 110 in such a manner that the moving speed of the slide door 3 may be rendered to a speed below the predetermined speed. This moving speed of the slide door 3 can be calculated, based upon ripple pulses obtained according to rotation of the motor 105 or the rotational speed of the motor 105. Further, the "braking control" as used in the context herein refers to controlling for limiting the moving speed of the slide door 3 through appropriate adjustment of the power transmitting/interrupting periods of the clutch mechanism 110. Preferably, this braking control is effected (controlled) by the control unit 90, with reference to an unillustrated preset map showing correlation between moving speeds of the slide door 3 and the power transmitting/interrupting periods of the clutch mechanism 110.

Meanwhile, this limiting of the moving speed can be effected optionally such that the moving speed of the slide door 3 is reduced to zero or such that the speed is reduced to e.g. ½, 1/10 etc. By effecting such controlling operations, it is possible to prevent sudden opening movement of the slide door 3. Further, it is also possible to arrange such that the user is allowed to manually close the slide door 3 during such moving speed control.

Similarly, with the inventive opening/closing body controlling apparatus 100, upon completion of the latch releasing movement of the slide door 3, the second returning movement of the sector gear 63 is effected. In this second returning movement, the sector gear 63 is pivoted forwardly and passes through the releasing region to enter the neutral region and then is stopped at the second neutral position. Detection of this second neutral position is effected, based on change of the signal of the neutral detecting second switch 85 from High (ON) to Low (OFF).

However, if such change of the signal of the neutral detecting second switch 85 from High (ON) to Low (OFF) cannot be detected due to e.g. some abnormality developed in the neutral detecting second switch 85, there is the possibility of the sector gear 63 passing through the neutral region to enter the closing region inadvertently. In such case, the opening/closing body controlling apparatus 100 may erroneously determine that a closing operation of the slide door 3 is about to take place, whereby an erroneous operation may take place. For this reason, in the case of the inventive opening/closing body controlling apparatus 100, the detection of the sector gear 63 in the second returning movement after a latch releasing operation is effected, based not only on the change of the signal of the neutral detecting second switch 85 from High (ON) to Low (OFF), but also on change of the signal of the neutral detecting first switch 84 from Low (OFF) to High (ON).

Therefore, in the second returning movement after a latch releasing operation, if the change of the signal of the neutral detecting second switch 85 from High (ON) to Low (OFF) cannot be detected, then the change of the signal of the neutral detecting first switch 84 from Low (OFF) to High (ON) is detected. With this, it becomes possible to stop the sector gear 63 in the neutral region appropriately. Incidentally, if the change of the signal of the neutral detecting first switch 84 from Low (OFF) to High (ON) is detected, the sector gear 63 is stopped at the first neutral position.

Further, with the opening/closing body controlling apparatus 100 according to the present invention, in the second returning movement after a latch releasing operation, in case neither the change of the signal of the neutral detecting second switch 85 from High (ON) to Low (OFF), nor the change of the signal of the neutral detecting first switch 84 from Low (OFF) to High (ON) are detected, the sector gear 63 again may reach the closing region. In such case, the opening/closing body controlling apparatus 100 will erroneously determine that a latch closing operation of the slide door 3 has been started and the latch closing movement may be allowed to continue. As a result, there may develop an erroneous external engagement in which the pivotal movement proceeds without the latch 41 receiving the striker 2 within the engagement recess 413. With such erroneous external engagement condition, the slide door 3 may be opened suddenly. For this reason, with this opening/closing body controlling apparatus 100 has an arrangement for preventing such erroneous external engagement thus preventing sudden opening of the slide door 3 as follows.

The control unit 90 included in the opening/closing body controlling apparatus 100 is configured to monitor the moving speed of the slide door 3 and to determine presence/absence of the braking control based upon the moving speed in case neither the first detection signal nor the second detection signal are detected after starting of the second returning movement. More particularly, with this control unit 90, if neither the first detection signal nor the second detection signal are detected within a predetermined period after start of the second returning movement, the unit 90 effects a braking control for reducing the moving speed of the slide door 3. In this, the start of second returning movement corresponds to timing of switchover of the rotational direction of the motor 61. That is, this is the timing that the control unit 90 controls such that the condition of the motor 61 being rotated clockwise in latch closing operation is changed to the condition of the motor 61 being rotated in the counterclockwise direction for the shifting to the second returning movement. The time lapse from the start of the second returning movement is measured by the timer controlling section 94 described above. And, when the measured time has reached the predetermined period, the power transmitted from the motor 61 to the sector gear 63 is transmitted or interrupted, thereby to effect the braking control for reducing the moving speed of the slide door 3 to a speed below a predetermined speed. This preset determination period is set as such period as from the start of the second returning movement of the sector gear 63 to the passing of the gear through the second neutral position.

In the second returning movement after a latch releasing movement, if nether the change of the signal of the neutral detecting second switch 85 from High (ON) to Low (OFF) nor the change of the signal of the neutral detecting first switch 84 from Low (OFF) to High (ON) are detected, then, the opening/closing body controlling apparatus 100 effects the second returning movement until the half latch switch 81 is switched from High (ON) to Low (OFF).

And, upon detection of the switchover of the half latch switch 81 from High (ON) to Low (OFF), the opening/closing body controlling apparatus 100 starts a latch closing movement. In this latch closing movement, if the moving speed of the slide door 3 is found to be higher than the predetermined speed, the opening/closing body controlling apparatus 100 effects the braking control. This braking control is same as those in the first returning movement described above. Therefore, explanation thereof will be omitted.

Further, in the latch closing movement, even if the moving speed of the slide door 3 is below the predetermined speed, when switchover of the half latch switch 81 from Low (OFF) to High (ON) is detected, the opening/closing body controlling apparatus 100 effects the braking control. On the other hand, in the latch closing movement, if the moving speed of the slide door 3 is below the predetermined speed AND the switchover of the half latch 81 from Low (OFF) to High (ON) is not detected, the latch closing operation is allowed to continue.

With execution of the above-described control, in the second returning movement of the striker effected after a latch releasing operation of the striker 2, the drawing-in condition of the striker 2 by the latch 41 is established without detection of the first detection signal and the second detection signal within the predetermined period, a latch closing movement is started and the brake control is effected. Therefore, even if the latch closing movement has been effected under the condition of the striker 2 and the latch 41 being operably un-engageable with each other, since the moving speed of the opening/closing body is controlled by the braking control, it is still possible to prevent opening/closing of the slide door 3 against the use's intension. Further, it is possible to prevent also collision between the striker 2 and the latch 41 under such mutually un-engageable condition. Hence, damage or deformation of the striker 2 and the latch 41 too can be restricted. Incidentally, it is also possible as a matter of course to arrange such that the user is allowed to manually close the slide door 3 during execution of such moving speed control.

Figure 9:
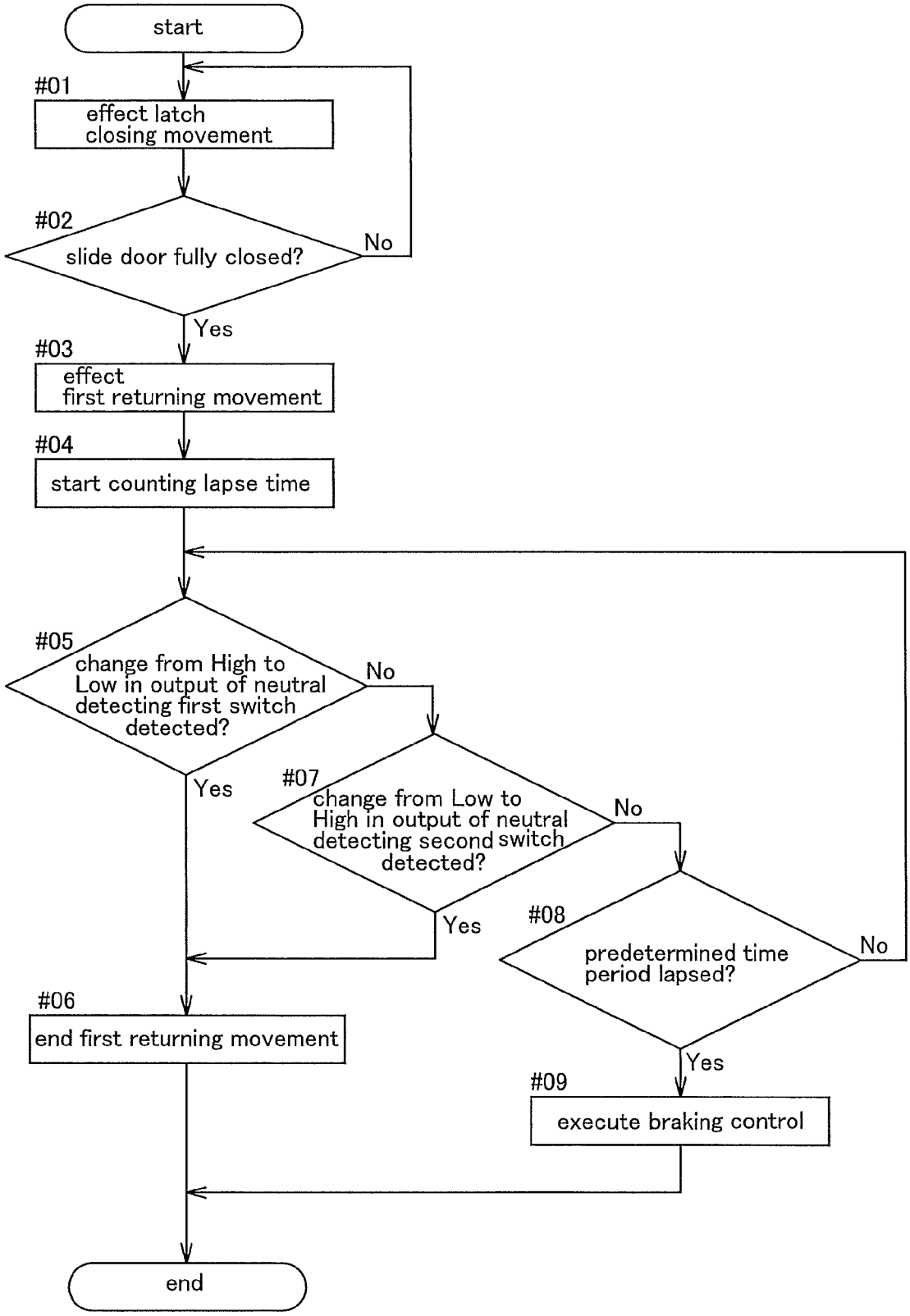
FIG. 9 is a flowchart relating to the latch closing movement.

Next, the operations carried out by the inventive opening/closing body controlling apparatus 100 will be explained with reference to flowcharts. FIG. 9 is a flowchart of the latch closing movement. First, for closing the slide door 3, the striker 2 enters the engaging recess 413 of the latch 41 and the latch 41 is pivoted. Further, as the latch 41 is pivoted and the half latch switch 81 is switched over from High (ON) to Low (OFF), the latch closing movement is started with forward driving of the motor 81 (step #01). This latch closing movement is continued until the latch 41 draws in the striker 2 completely and reaches the full latch position.

With realization of the full latch position above, the slide door 3 is under its fully closed state (step #02: No). And, when the slide door is fully closed (step #02: Yes), the motor 61 is stopped and the first returning movement is effected for returning the sector gear 63 from the closing region to the neutral region, in this case, the first neutral region (step #03). At the same time, the timer controlling section 94 starts counting the lapse time after the start of the first returning movement (step #04).

Then, the process effects confirmation whether the state of the neutral detecting first switch 84 has changed from High (ON) to Low (OFF) or not. The neutral returning movement of the sector gear 63 at this stage is effected after arrival of the latch 41 at the full latch position. Therefore, under a normal condition, the neutral detecting first switch 84 is at High (ON) state. Upon detection of change of the state of the neutral detecting first switch 84 from High (ON) to Low (OFF) (step #05: Yes), the motor 61 is stopped. And, the first returning movement of the sector gear 63 is ended (step #06) and the process is completed.

On the other hand, at step #05, if the change of the state of the neutral detecting first switch 84 from High (ON) to Low (OFF) is not detected (step #05: No), confirmation is made whether the state of the neutral detecting second switch 85 has changed from Low (OFF) to High (ON) or not. If this change in the state of the neutral detecting second switch 85 from Low (OFF) to High (ON) is detected (step #07: Yes), the motor 61 is stopped. And, the first returning movement of the sector gear 61 is ended (step #06) and the process is completed.

At step #07, if the change of the state of the neutral detecting second switch 85 from Low (OFF) to High (ON) is not detected (step #07: No), the process determines whether the lapsed time counted by the timer controlling section 94 after the start of the first returning movement has reached the predetermined determination period or not. If it is determined that the lapsed time has not yet reached the determination period (step #08: No), then, the process returns to step #05 and continues the process. On the other hand, if it is determined that the lapsed time has reached the determination period (step #08: Yes), in order to prevent sudden opening of the slide door 3, the braking control is executed by appropriately controlling the power transmission permitting/interrupting period of the clutch mechanism 110 (step #09). With effecting such processes as above, the opening/closing body controlling apparatus 100 according to the present invention can effectively prevent inadvertent opening of the slide door 3 unintended by the user.

Figure 10:
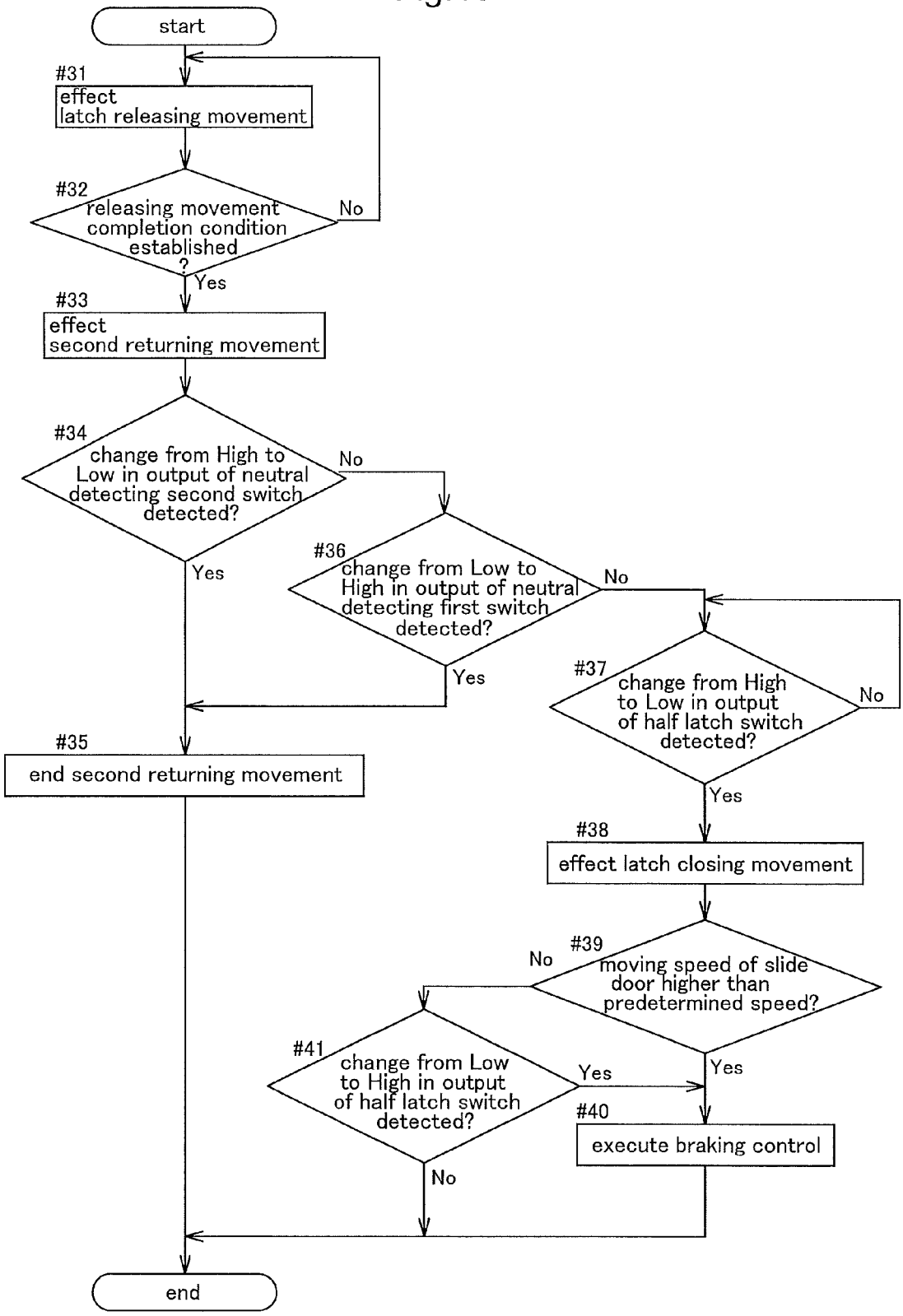
FIG. 10 is a flowchart relating to the latch releasing movement.

Next, the processing relating to the latch releasing movement will be explained with reference to the flowchart of FIG. 10 relating to the latch releasing movement. First, in response to an operation of a switch or the like by the user, a latch releasing movement is started (step #31) and the motor 61 is driven in reverse. This latch releasing movement is effected until establishment of a latch releasing movement completion condition (step #32: No). Here, the language "latch releasing movement completion condition" is understood to mean detection of the moving distance of the slide door 3 from the fully closed condition to its fully opened condition based on ripple pulses outputted according to the rotation of the motor 61 or detection of the same based on switchover of the state of the half latch switch 81.

Upon establishment of the latch releasing movement completion condition (step #32: Yes), the motor 61 is stopped and the second returning movement is effected for returning the sector gear 63 from the releasing region to the neutral region, in this case, the second neutral region (step #33).

And, confirmation is made whether the state of the neutral detecting second switch 84 has changed from High (ON) to Low (OFF) or not. Here, this neutral returning movement of the sector gear 63 is effected after the latch 41 has been rendered into the posture for releasing the striker 2. Therefore, under a normal condition, the neutral detecting second switch 85 is at High (ON) state. Then, upon detection of the change of the state of the neutral detecting second switch 85 from High (ON) to Low (OFF) (step #34, Yes), the motor 61 is stopped. And, the second returning movement of the sector gear 63 is ended (step #35) and the process is completed.

On the other hand, at step #34, if the change of the state of the neutral detecting second switch 85 from High (ON) to Low (OFF) is not detected (step #34: No), confirmation is made whether the state of the neutral detecting first switch 84 has changed from Low (OFF) to High (ON) or not. If this change in the state of the neutral detecting first switch 84 from Low (OFF) to High (ON) is detected (step #36: Yes), the motor 61 is stopped. And, the second returning movement of the sector gear 63 is ended (step #35) and the process is completed.

At step #36, if the change of the state of the neutral detecting first switch 84 from Low (OFF) to High (ON) is not detected (step #36: No), confirmation is made whether the state of the half latch switch 81 has changed from High (ON) to Low (OFF) or not. If this change in the state of the half latch switch 81 from High (ON) to Low (OFF) is not detected (step #37: No), the process is suspended.

If the change of the output of the half latch switch 81 from High (ON) to Low (OFF) is confirmed (step #37: Yes), the motor 61 is driven forwardly, thereby to start a latch closing operation of the sector gear 63 (step #38). And, detection is made for the moving speed of the slid door 3 in this latch closing operation. This detection of the moving speed is effected, preferably, based on ripple pulses obtained in accordance with rotation of the motor 61. If the moving speed of the slide door 3 is found to be higher than the predetermined speed (step #39: Yes), the braking control is effected through appropriate control of the power transmitting/interrupting period of the clutch mechanism 110 (step #40).

On the other hand, at step #39, if the moving speed of the slide door 3 is determined to be below the predetermined speed (step 39: No), the first retuning movement after a latch closing operation is effected. That is, if the latch 41 is normally engaged with the striker 2, the moving speed of the slide door 3 is below the predetermined speed. Therefore, in this case, the operation is determined normal, so the first returning movement is effected. And, in this first returning movement, confirmation is made whether the output of the half latch switch 81 has changed from low (OFF) to High (ON) or not. If this change of the output of the half latch switch 81 from low (OFF) to High (ON) is detected (step #41: Yes), the process determines that the first returning movement has reached the latch releasing movement due to e.g. some operational abnormality in the neutral detecting switches 84, 85, so the process effects the braking control through appropriate control of the power transmitting/interrupting period of the clutch mechanism 110 (step #40). Further, in the first returning movement, if the change of the output of the half latch switch 81 from low (OFF) to High (ON) is not detected (step #41: No), the process determines that the first returning movement has bee completed normally, thus completing this process once. By effecting the above-described processes, the opening/closing body controlling apparatus 100 according to the present invention can prevent the erroneous external engagement condition of the latch 41, thus preventing inadvertent opening of the slide door 3 unintended by the user.

Other Embodiments

In the foregoing embodiment, the opening/closing body controlled by the inventive opening/closing body controlling apparatus 100 has been described as a slide door 3 mounted in a vehicle. However, the applicable scope of the present invention is not limited thereto. The opening/closing body can be a tailgate door provided in a vehicle or any other door, as a matter of course. Moreover, the opening/closing body is not limited to such vehicle doors, but can be a door in a building or the like, as a matter of course.

In the foregoing embodiment, the door opening/closing mechanism 40 is provided on the slide door 3 side whereas the striker 2 is provided on the vehicle body 1 side. However, the applicable scope of the present invention is not limited thereto. It is also possible to provide the door opening/closing operation mechanism 40 on the vehicle body 1 side and to provide the striker 2 on the slide door 3 side, as a matter of course.

INDUSTRIAL APPLICABILITY

The present invention is applicable to an opening/closing body controlling apparatus capable of a latch closing operation for establishing engagement between a latch and a striker and a latch releasing operation for releasing the engagement between the latch and the striker, through pivotal displacement based on motor operation.

The invention claimed is:

1. An apparatus for controlling an opening/closing body for automatically opening/closing the opening/closing body, the apparatus comprising:

a latch for drawing in and releasing a striker;

a pawl engageable with the latch;

a latch closing operation mechanism operatively connected to the latch and a latch releasing operation mechanism operatively connected to the pawl;

a displacement body operatively connected to said latch closing operation mechanism and said latch releasing operation mechanism, said displacement body being movable by a motor operatively connected to said displacement body so that said displacement body is displaced between movable regions including a latch closing region for operating said latch closing operation mechanism to move said latch to draw-in said striker, a latch releasing region for operating said latch releasing operation mechanism to move said pawl out of engagement with said latch so that said striker is releasable, and a neutral region located between said latch closing region and said latch releasing region;

a first detecting section configured to output a first detection signal in response to passage of the displacement body through a first boundary portion of the neutral region on the side of the closing region;

a second detecting section configured to output a second detection signal in response to passage of the displacement body through a second boundary portion of the neutral region on the side of the releasing region; and a control unit for configured to control a moving speed of the opening/closing body and effecting braking control for reducing the moving speed of the opening/closing body if neither the first detection signal nor the second detection signal are detected within a predetermined period after starting of a neutral returning movement which is effected after the latch closing movement of the opening/closing body for returning said displacement body from said latch closing region to said neutral region.

2. An apparatus for controlling an opening/closing body for automatically opening/closing the opening/closing body, the apparatus comprising:

a latch for drawing in and releasing a striker;

a pawl engageable with the latch;

a latch closing operation mechanism operatively connected to the latch and a latch releasing operation mechanism operatively connected to the pawl;

a displacement body operatively connected to said latch closing operation mechanism and said latch releasing operation mechanism, said displacement body being movable by a motor operatively connected to said displacement body so that the displacement body is displaced between movable regions including a latch closing region for operating said latch closing operation mechanism to move said latch to draw-in said striker, a latch releasing region for operating said latch releasing operation mechanism to move said pawl out of engagement with said latch so that said striker is releasable, and a neutral region located between said latch closing region and said latch releasing region;

a first detecting section configured to output a first detection signal in response to passage of the displacement body through a first boundary portion of the neutral region on the side of the closing region;

a second detecting section configured to output a second detection signal in response to passage of the displacement body through a second boundary portion of the neutral region on the side of the releasing region; and a control unit for effecting braking control for starting a latch closing movement and reducing the moving speed of the opening/closing body if a drawing-in condition for said striker by said latch is established when neither the first detection signal nor the second detection signal are detected within a predetermined period after starting of a neutral returning movement which is effected after the latch closing movement of the opening/closing body for returning said displacement body from said releasing region to said neutral region.

3. The opening/closing body controlling apparatus according to claim 2, wherein said control unit is configured to monitor the moving speed of the opening/closing body in case the latch closing movement is effected in the absence of detections of the first detection signal and the second detection signal and to determine presence/absence of said braking control based on the monitored moving speed.

4. The opening/closing body controlling apparatus according to claim 1, further comprising a clutch mechanism disposed between said opening/closing body and a second motor for opening/closing this opening/closing body, said clutch mechanism transmitting/interrupting the power of said second motor so that opening/closing body is selectively moved; and wherein said braking control is configured to render the moving speed of said opening/closing body below a predetermined speed.

5. The opening/closing body controlling apparatus according to claim 4, wherein said control unit is configured to effect said braking control based upon a map showing correlation between moving speeds of the opening/closing body and power transmitting/interrupting periods of said clutch mechanism.

6. The opening/closing body controlling apparatus according to claim 1, wherein said control unit is configured to render the moving speed of the opening/closing body zero in said braking control.

* * * * *